US008844885B1

(12) United States Patent
Reece-Sullivan

(10) Patent No.: US 8,844,885 B1
(45) Date of Patent: Sep. 30, 2014

(54) FABRIC SUSPENSION SYSTEM

(76) Inventor: Martin A. Reece-Sullivan, Ashland, OR (US)

( * ) Notice: Subject to any disclaimer, the term of this patent is extended or adjusted under 35 U.S.C. 154(b) by 468 days.

(21) Appl. No.: 11/523,241

(22) Filed: Sep. 19, 2006

Related U.S. Application Data

(60) Provisional application No. 60/718,824, filed on Sep. 20, 2005.

(51) Int. Cl.
*G09F 17/00* (2006.01)

(52) U.S. Cl.
USPC ..... 248/214; 40/603

(58) Field of Classification Search
USPC ..... 248/475.1, 225.11, 223.41, 214, 200.1; 40/603, 604, 792–796
See application file for complete search history.

(56) References Cited

U.S. PATENT DOCUMENTS 2,201,043 A * 5/1940 Kirsch ..... 211/105.3
4,717,101 A * 1/1988 Harrod ..... 248/200.1
4,809,401 A 3/1989 Honig
5,040,586 A * 8/1991 Hillstrom ..... 160/383
6,088,942 A * 7/2000 Brooks et al. ..... 40/603
6,260,600 B1 * 7/2001 Miller ..... 160/38
6,305,559 B1 * 10/2001 Hardy ..... 211/184
6,862,825 B1 * 3/2005 Lowndes ..... 40/603
7,178,281 B2 * 2/2007 Johansson et al. ..... 40/603
7,260,908 B2 * 8/2007 Devaney ..... 40/590
7,350,759 B1 * 4/2008 Gray ..... 248/644

OTHER PUBLICATIONS

U.S. Appl. No. 60/718,824.
"Simply Invisible TM", Quilt Hanging Kit, Instruction Sheet. Available from: Wooden Whale, Holstein, Ontario, Canada N0G2A0. ableco@inestonic.com.

* cited by examiner

*Primary Examiner* — Steven Marsh

(57) ABSTRACT

A suspension system for hanging fabric articles such as quilts or the like from a vertical surface such as a wall or partition. A C-shaped bar is passed through a sleeve of the fabric article which is conventionally provided for accommodating a hanger. A mounting bracket has a projecting tab which enters the opening of the bar and engages the sleeve. The article is pinned in place by its own weight in a manner which avoids making or needing holes in the sleeve, while concealing of the mounting apparatus. The mounting bracket engages the wall by adhesive or fasteners, or alternatively is suspended from a wall mounted rod from above. Optionally, an integral motion detector operates an alarm.

15 Claims, 7 Drawing Sheets

FABRIC SUSPENSION SYSTEM

RELATED APPLICATIONS

This application is a Continuation-in-Part of U.S. Provisional Patent Application Ser. No. 60/718,824 filed Sep. 20, 2005 and claims priority thereto in accordance with 35 U.S.C. §119(e).

FIELD OF THE INVENTION

The present invention relates to apparatus and methods of suspending fabric articles such as quilts from vertical surfaces, as for display.

BACKGROUND OF THE INVENTION

Makers of fabric articles such as quilts, wall hangings, hand made blankets, banners, tapestries, weavings, needle art, embroidery, flags, rugs, carpets, curtains, drapes, fabric or soft sculptures, and other like articles display these from time to time. In fact, articles that may benefit from the invention may include any flexible, generally planar article such as paper, cardboard, non-woven fabrics, animal hides, plastic sheets, and still others. As such articles may be somewhat large, arranging them in large numbers for public exhibitions entails certain difficulties. To display a fabric article to best effect, the article must be spread out flat, preferably in a vertical plane such as against a wall, which requires considerably more space than would be required to store the article in a folded condition. Typically, those displaying such articles suspend each article from a suitable support so that the articles hang straight down due to gravity.

The most frequently practiced way to suspend fabric articles is from the top edge. Sleeves and loops are conventionally sewn or otherwise affixed to the back of the fabric near the top edge to accommodate a pole or other support structure such as hooks. Poles, where used, are typically greater than the width of the article being displayed. The pole or hooks are then suspended from a wall, partition, or display frame by suitable brackets or in any other suitable way.

While these measures succeed, they suffer from undesirable characteristics. Illustratively, poles, hooks, chains, and their supporting structure which are visible when the fabric article is displayed detract from the appearance of these fabric articles such as quilts which are, after all, forms of art work.

DESCRIPTION OF THE RELATED ART

The prior art has attempted to develop suspension systems that eliminate exposure of suspension components. Some of these require that holes be present in the sleeve of the fabric article, for example to accommodate support brackets. This also is undesirable since the suspension arrangement can still be excessively conspicuous and further may cause the sleeve to bunch or tear or otherwise distort its appearance. A notable example is when poles supported at their two extreme ends are used to support the displayed article. Because they span a significant extent unsupported in the middle, they must be of relatively large diameter. This creates a bulge in the displayed article which bulge is perceptible from the front or displayed surface. The requirement for holes requires that intact or unslit sleeves, which are frequently the type of sleeve provided, be cut or slit. This adds a step to preparation for display, and may introduce distortions in the fabric article.

U.S. Pat. No. 4,809,401, issued to Honig on Mar. 7, 1989, shows engagement of a drapery pole (see FIG. 5). The arrangement of Honig would have a greater tendency to tear or distort quilts or like objects, compared to the less intrusive interaction of a pole or the like and its supporting bracket of the present invention.

There remains a need for suspension apparatus for suspending a fabric article in vertical orientation, which conceals or minimizes exposure of the suspension apparatus.

SUMMARY OF THE INVENTION

The present invention is a support or mounting system for engaging a fabric article having a sleeve for receiving a pole or the like for suspending the article. The system includes a first member, which occupies the sleeve, and a second member that, together with the first member, interengages the sleeve without penetrating the sleeve. The first member is preferably a C-shaped bar, and the second member is a bracket bearing a projection or finger which enters the opening of the C. The two members interfit to a degree to entrap the sleeve between the two members to form a curved or serpentine path as it winds between the projections of the two suspension members. This interfit and serpentine path enable the suspension members to engage and support the fabric article without piercing or penetrating the sleeve, and without requiring that any piercings or penetrations be preformed in the sleeve, while enabling the fabric article to conceal the suspension system when suspended thereby. Weight of the suspended fabric article urges the two members against one another, thereby promoting stability of the assembled suspension system and the fabric article.

One of the two members is a bracket which attaches to a wall or other vertical environmental surface, or which in an alternative embodiments may be suspended from a rod, pole, wire, hooks, or the like provided to support fabric articles. This bracket receives adhesive or driven fasteners to engage the wall. No other component of the system, apart from other such brackets if plural brackets are utilized, is necessarily subjected to adhesives and fasteners.

The novel system saves time over prior art practice, especially where poles inserted through the sleeves are used, because the entire fabric article with the pole must be handled to mount and adjust the same. By contrast, one or more small brackets used in the novel suspension system may be mounted and leveled on a wall or other environmental supporting surface without involving the fabric article and the C-shaped bar. Then, the latter two components are assembled, the brackets having been mounted before.

It is an object of the invention to provide a suspension system for suspending a fabric article such as a quilt having a mounting sleeve extending along one side thereof on a vertical surface such as a wall or partition, without piercing or penetrating any part of the fabric including the sleeve, and without requiring that any part of the fabric including the sleeve be pre-formed to include a hole, piercing, or other interruption of continuity of its constituent fabric.

It is another object of the invention to provide a suspension system for a fabric article which entirely conceals suspension structure which must contact the fabric article for the purpose of engaging the same.

A further object of the invention is to exploit gravity acting on the weight of the fabric article to assist in retaining the fabric article on a suspension system.

Still another object of the invention is that only one or more wall brackets use fasteners or adhesive, and no other component of the suspension system need be fastened to another component of the system or to an environmental entity by fastener or by adhesive.

It is another object of the invention to save time in mounting fabric articles for display.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
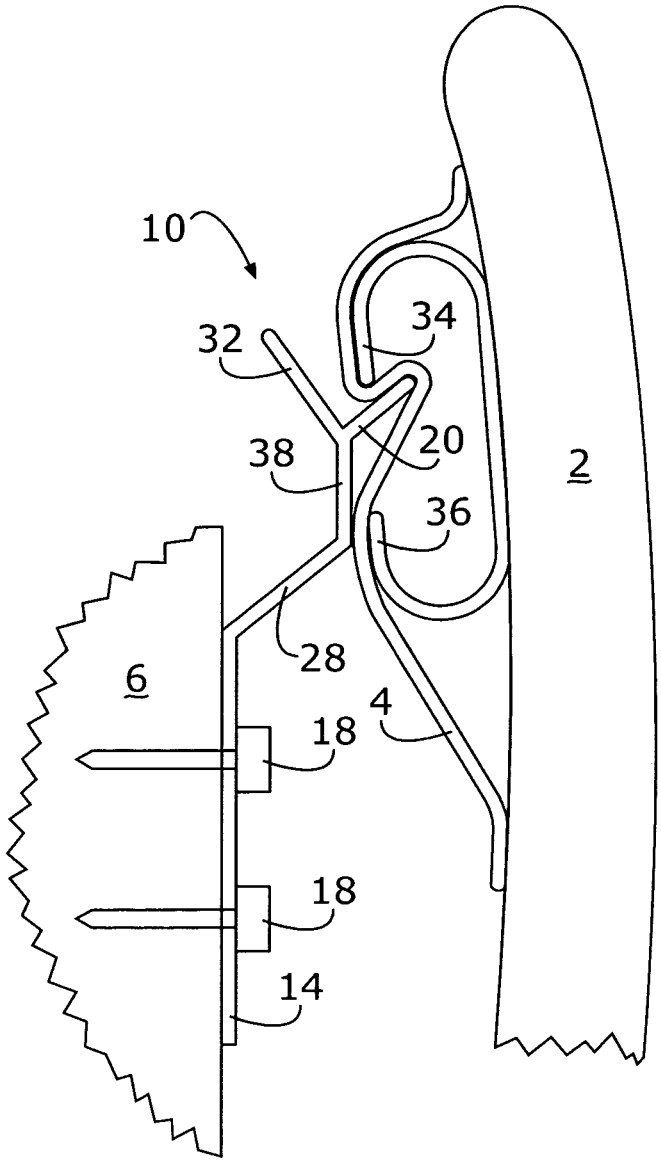
FIG. 1 is an environmental end elevational view of one embodiment of the invention, showing how the sleeve of a fabric article is entrapped within the novel suspension system and one way in which the novel suspension system engages a wall.

FIG. 1 of the drawings shows one embodiment of a suspension system for suspending a fabric article 2 having a sleeve 4 extending horizontally therealong from an environmental support so as to generally occupy a vertical plane. As employed herein, terms pertaining to orientation will refer to directions and associated orientation when fabric article 2 is mounted to a generally vertical environmental surface so as to hang generally vertically. In FIG. 1, fabric article 2 is depicted as being attached to a wall 6. Of course, the embodiment of FIG. 1 would be suitable for use with a partition, door, free standing panel, or any other corresponding generally vertical surface suitable for receiving the weight of and having space to display fabric article 2.

The principal components of the suspension system of FIG. 1 include a mounting bracket 10 and an elongated bar 12. Mounting bracket 10 is disposed to transfer weight of fabric article 2 and its sleeve 4 to an environmental support which is in the depiction of FIG. 1 wall 6. To this end, and referring also to FIG. 2, mounting bracket 10 has a broad wall engaging portion 14 having a flat surface bearing holes 16 for receiving and retaining driven fasteners 18. Fasteners 18 could be screws, nails, tacks, wall anchors, hooks, or any other manually or tool driven device for securing mounting bracket 10 to wall 6. Wall engaging portion 14 is one embodiment of an engagement element for engaging an environmental supporting surface or object and attaching mounting bracket 10 from the environmental support. Mounting bracket 10 is also seen to have fixed thereto a projection 20 the purpose of which will be explained presently.

It will be appreciated that in some circumstances the fastening element for gripping wall 6 or other environmental vertical support surface may be any suitable adhesive, such as a construction mastic, hook and loop fastener, a permanently hard setting cement, or any other material capable of sustaining the weight of fabric article 2. Adhesive will be understood to encompass substances which display tackiness characteristics, substances which cure or evolve to permanently engage surfaces which they contact, and substances and materials which interact so as to be manually separable and reattachable. Regardless of the fastening element which is chosen, it will be capable of maintaining mounting bracket 10 at a predetermined location on the environmental vertical support surface when the weight of fabric article 2 is imposed on the suspension system.

Elongated bar 12 is intended to be placed inside sleeve 4 of fabric article 2. Elongated bar 12 has at least one slot 22. It is preferred that one slot 22 be formed in elongated bar 12 and extend continuously along the length of elongated bar 12, although several shorter slots, holes, or openings arranged in series along elongated bar 12 (this is not shown) could be provided if desired. It is a significant advantage of slot 22 that slot 22 will accommodate location of bracket 10 anywhere along elongated bar 12. No precise measuring to establish bracket location is required. Also, caps or other structure (not shown) could be provided at the ends of elongated bar 12 such that slot 22 would not extend along the entire length. Of course, the slots, holes, or openings may be continuous or discontinuous along elongated bar 12. They may, for example, be located at a small number of predetermined locations, and may be dimensioned and configured to receive projection 20 in close cooperation along the length of elongated bar 12. It is preferred, however, that slot 22 extend the full length of elongated bar 12 to permit adjustment of location of projection 20 with respect to elongated bar 12 at the user's discretion.

Projection 20 is dimensioned and configured to enter and occupy slot 22 while leaving sufficient room to entrap fabric such as sleeve 4 within slot 22 between itself and elongated bar 12. As seen in FIG. 1, when mounting bracket 10 and elongated bar 12 are in their deployed positions supporting fabric article 2, such as the material of sleeve 4, constituent material of sleeve 4 is forced into a serpentine path as it extends around the curved surfaces of bar 12 and around projection 20 of mounting bracket 10.

It will be noted that the vertical member of elongated bar 12 opposite the slot is flat and vertically oriented when elongated bar 12 is in the deployed position depicted in FIG. 1. These characteristics help in avoiding bulging of fabric article 2 where the latter contacts elongated bar 12. This is an improvement over prior art suspensions wherein a circular pole or the like (not shown) is inserted into sleeve 4, especially where sleeve 4 has little slack to accommodate horizontal displacement by large diameter rods or poles. Such displacement has caused noticeable and objectionable bulging of fabric article 2 visible from the front thereof.

Another important characteristic and advantage of the invention is that elongated bar 12 is dimensioned and configured to make abutting contact against mounting bracket 10 at a point which is both below projection 20 of mounting bracket 10 and is also outside slot 22. In the arrangement of FIG. 1, abutting contact occurs with affected members located in horizontal opposition when deployed (the affected members being lower end 36 of elongated bar 12 and section 38 of bracket 10, which will be described further hereinafter). The advantage of this arrangement is that fabric of sleeve 4 need only wind around projection 20, rather than having to also wind around additional structure of either bracket 10 or elongated bar 12. Noting that aspects of the present invention encompass abutment and contact between mounting bracket 10 and elongated bar 12, it must be stressed that abutment and contact are said to occur as if fabric of sleeve 4 of fabric article 2 did not intervene between mounting bracket 10 and elongated bar 12.

Figure 2:
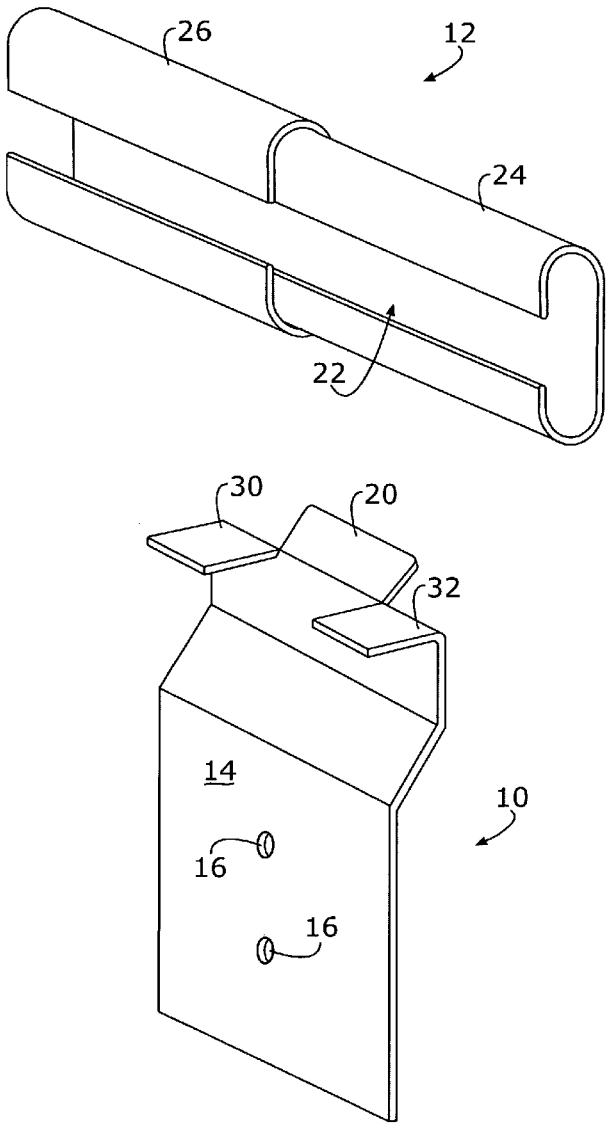
FIG. 2 is an exploded view of the two principal components of the suspension system of FIG. 1.

As is clearly seen in FIG. 2, elongated bar 12 is preferably formed in two generally similar sections 24, 26 each of which slidably or telescopically engages the other so as to enable sliding adjustment of the collective length of sections 24 and 26. This feature enables the effective length of elongated bar 12 to be adjusted most advantageously to the actual length of fabric article 2. Similarity of the two sections 24, 26 is intended to relate to their mutual interfit. Structural dissimilarities such as the nature of slots or holes, of constituent material, color, surface roughness, internal or external configuration, and other characteristics are not encompassed by the term similarity.

It is preferred that elongated bar 12 be adjusted so as not to be visible at the ends of sleeve 4. As the overall length of a large quilt or other fabric article 2 may become rather heavy, it may become desirable to provide a plurality of mounting brackets 10. In such a case, each mounting bracket 10 would be independently affixed to wall 6, arranged so that the projection 20 of each would engage slot 22 of elongated bar 12 as described prior.

It is presently contemplated that elongated bar 12 may be formed from sheet metal or the like. However, other constructions are possible. For example, elongated bar 12 may be formed from a wooden or plastic pole. Slot 22 may be molded or routed or otherwise formed in the pole. It is presently contemplated that a single slot be formed in the bar, the slot extending the full length of the bar. However, the slot may be modified to extend less than the full length of the bar or alternatively, that several slots be provided along the bar.

Although not strictly critical to the invention, mounting bracket 10 preferably has a spacer which is disposed to space fabric article 2 away from the environmental vertical support surface when fabric article 2 is suspended on the suspension system. This function is provided by section 28 of mounting bracket 10, which section 28 is arranged at approximately a forty-five degree angle to wall engaging portion 14. The precise angle and nature of the spacer are not critical. The spacer is particularly useful where fabric articles may be displayed on exterior walls, large windows, and the like, which may possibly be susceptible to condensation and other sources of moisture.

In the embodiment of FIG. 1, mounting bracket 10 is formed by shaping a piece of sheet metal. Bending projection 20 as seen in FIG. 2 leaves two tabs 30, 32 which are preferably bent as shown to form a V-shaped valley therebetween. Upper end 34 (see FIG. 1) may come to seat within this valley. This has the consequence that elongated bar 12 will be constrained in a generally vertical orientation, and will resist rotating and wobbling. Positioning of elongated bar 12 is thus made more stable. It will be seen from FIG. 3 that elongated bar 12 has a height H when oriented in the deployed position and a thickness T in the deployed condition. Thickness T is less in magnitude than is height H. This configuration enables lower end 36 of elongated bar 12 to prop itself against section 38 of mounting bracket 10, with constituent material of sleeve 4 separating lower end 36 and section 38. These components are also seen in FIG. 4, from which fabric article 2 and its sleeve 4 have been deleted. In summary, mounting bracket is dimensioned and configured to maintain elongated bar 12 in an orientation such that height H of elongated bar 12 is generally vertical when elongated bar 12 is in the deployed condition.

Another important consequence of this construction is that mounting bracket 10 and elongated bar 12 each have corresponding abutment portions near the lower end 36 of elongated bar 12. These abutment portions need not literally abut. As seen in FIG. 1, contact of mounting bracket 10 with elongated bar 12 is prevented by intervening material of sleeve 4. Where the novel system is employed with fabric articles having loops rather than continuous sleeve 4, mounting bracket 10 and elongated bar 12 may contact one another directly at several points including the abutment portions. Regardless of whether actual contact is made, the abutment portions oppose pivotal disengagement of elongated bar 12 from projection 20 of mounting bracket 12 by interference should elongated bar 12 be subjected to a bending or pivoting moment imposed by the weight of fabric article 2. This occurs since the corresponding abutment portions are located below the point of weight supporting contact of mounting bracket 10 and elongated bar 12 when the novel suspension system is in the deployed condition depicted in FIG. 1. As employed herein, the deployed condition may encompass actual supporting contact of fabric article 2, or alternatively may be considered to encompass only the positional relationship of mounting bracket 10 and elongated bar 12 when these components are supporting fabric article 10.

Inclusion of abutment portions is preferred for stability, but is not critical to the invention.

Figure 3:
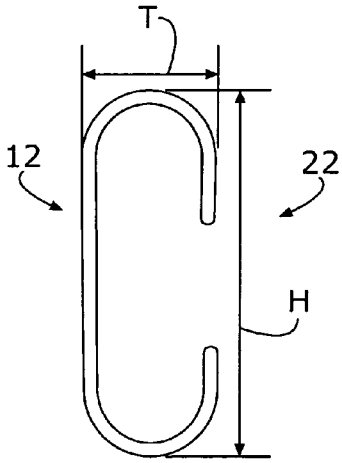
FIG. 3 is a side elevational detail view of the component seen in the upper right of FIG. 2.
Figure 4:
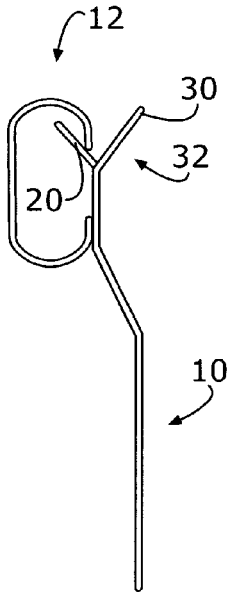
FIG. 4 is an end elevational view showing interengagement of the two principal components of FIG. 2, without a fabric article being engaged thereby.

It is not necessary that elongated bar 12 have the generally elongated C-shape in cross section as depicted in FIGS. 1, 2, and 3. C-shaped, as employed in this description, signifies that the outer surfaces collectively form a smoothly or gently curved outer parametric boundary which will not snag, stick on, or similarly engage a woven fabric in a destructive or potentially destructive manner, such as would occur for example by having a sharp corner pierce the fabric or engage an interstitial space between constituent filaments of the fabric. The C-shape is seen when the bar is viewed in end elevation or in cross section. The bar may be capped if desired. If a cap or other structure is provided at the exposed ends, then the C-shape is that which is seen when the cap or other structure is removed. The bar need not literally be C-shaped as long as outer surfaces will not engage fabric of the article destructively, while still accommodating or forming a slot or opening for receiving the tab or projection of the wall bracket.

Elongated bar 12 is preferably non-circular, when viewed in cross section or from the end, as seen in FIG. 1. In addition to presenting a flat face to fabric article 2, the non-circular configuration, preferably with height exceeding depth, assists in stabilizing elongated bar 12 when installed as depicted in FIG. 1. This is achieved by, in conjunction with the propping surface formed at lower end 36 of elongated bar 12, rendering elongated bar 12 less likely to pivot out of engagement with projection 20. It should be noted here that propping surface 36 and abutment portion 38 act together to maintain the face of bar 12 vertical.

Figure 5:
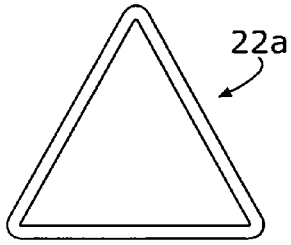
FIG. 5 is an end elevational view of another embodiment of the component seen at the upper right of FIG. 2.
Figure 6:
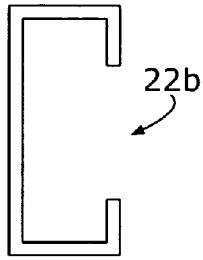
FIG. 6 is an end elevational view of still another embodiment of the component seen at the upper right of FIG. 2.
Figure 7:
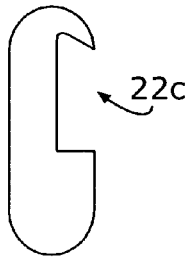
FIG. 7 is a cross sectional view of still another embodiment of the component seen at the upper right of FIG. 2.

FIGS. 5, 6, and 7 illustrate some alternative cross sectional configurations. Nonetheless, it remains important that respective slots 22A (FIG. 5), 22B (FIG. 6), or 22C (FIG. 7) be present to receive projection 20 of mounting bracket 10.

Regardless of the selected cross sectional configuration of the elongated bar, its diameter and weight are reduced from those of poles and rods (not shown) which are inserted through sleeves and supported from their extreme ends. Supporting the elongated bar at several points along the length of the fabric article, and not just at the right and left ends, enables a reduction in dimensions and weight, compared to a full length pole or rod supported at the ends. Reduced diameter also reduces bulging of the fabric article, as well as the flat profile at the front of the elongated bar.

Figure 8:
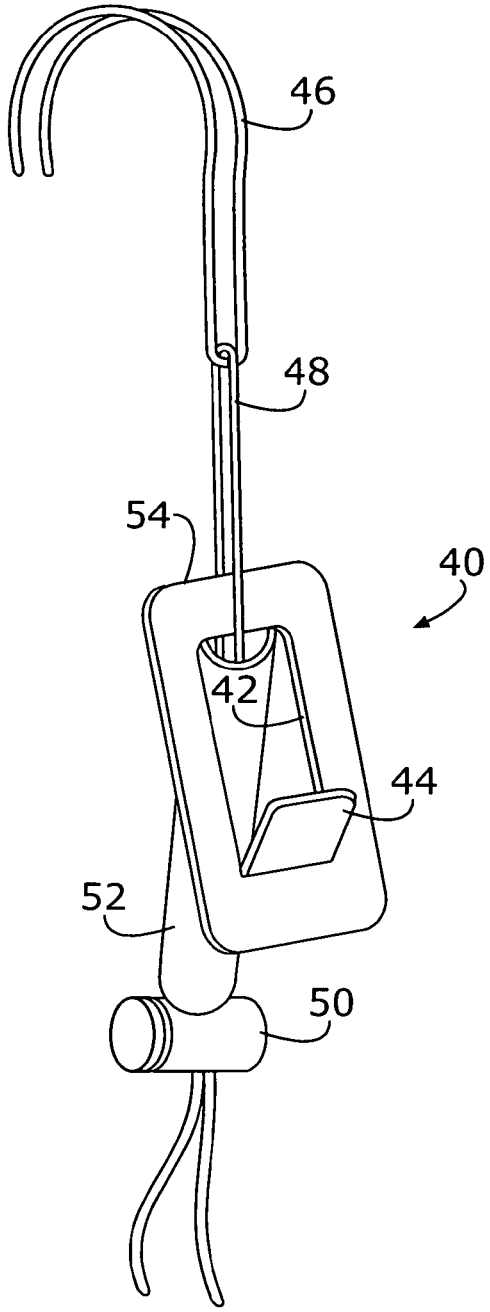
FIG. 8 is a perspective view of an alternative embodiment of the invention, showing an alternative to the component seen at the lower left of FIG. 2, and associated apparatus for enabling suspension from a pole, wire, or other supporting structure (none of these is shown).
Figure 9:
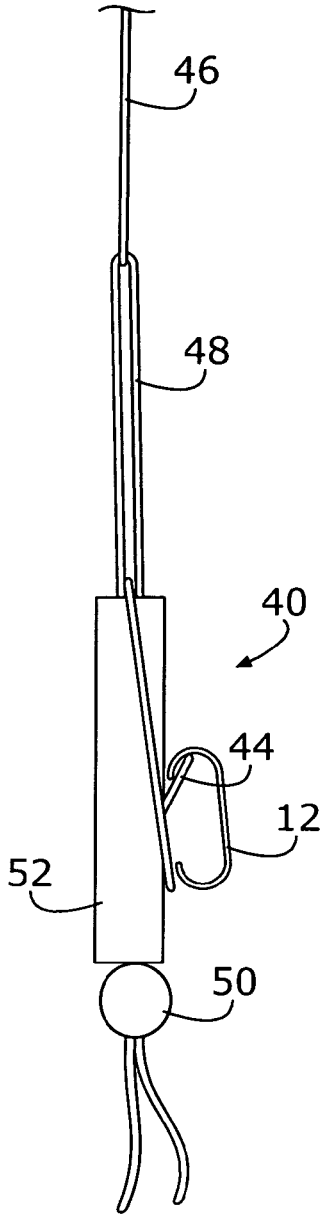
FIG. 9 is a side elevational view of FIG. 8.

Turning now to FIGS. 8 and 9, the present invention also accommodates suspending a fabric article from a horizontal rod, pole, cable, ceiling, or any other overhead supporting structure which may be provided for example at exhibition facilities for suspending fabric articles. An alternative embodiment of the novel suspension system includes a mounting bracket 40 which is the functional equivalent of mounting bracket 10 of FIG. 1, although mounting bracket 40 is modified to incorporate a hook arrangement for supporting weight of the fabric article (e.g., fabric article 2) from an overhead horizontal elongated support member (not shown). Mounting bracket 40 has an opening 42 formed therein and a projection 44 which is functionally a counterpart of projection 20. That is, projection 44 is dimensioned and configured to enter and occupy the same slot 22 of elongated bar 12 as is engaged by projection 20 of mounting bracket 10. The same elongated bar 12 may be utilized in the embodiment of FIGS. 8 and 9 as was employed in the embodiment of FIG. 1.

The hook arrangement includes a hook 46 disposed to engage, for example, by partially encircling the elongated support member (not shown), and a cord 48 which engages hook 46 and which passes through opening 42 of and engages mounting bracket 40. In the preferred embodiment, the hook arrangement includes a cord lock 50. Cord locks are known, and by way of brief explanation, comprise a body, a passage extending entirely through the body for receiving a cord such as cord 48 and a manual element which engages and immobilizes the cord, so that the cord lock does not travel or slip along the cord. In the preferred embodiment, which is operable by only one hand, the cord lock has an internal spring which biases an internal plunger or locking member to immobilize the cord by pinching the same, and a manual release button for releasing grip of the locking member on the cord. Other types of cord locks, such as those employing wedging action may be employed, or any device serving as a stop to prevent mounting bracket 40 from moving past a predetermined desired point along cord 48. Cord 48 could be knotted to establish a stop, if desired. When the cord is released, position of cord lock 50 along the length of cord 48 and thus the effective length of cord 48 between hook 46 and mounting bracket 40 may be adjusted. This enables vertical adjustment of the location of mounting bracket 40 below hook 46 so that the fabric article can be selectively positioned with respect to the overhead horizontal elongated support member. Cord 48 could comprise a single filament rather than a two filament closed loop as depicted.

It will be appreciated that the hook arrangement is merely representative of many types of attachment apparatus which may be employed to suspend cord 48 from an overhead support. In the hook arrangement, mounting bracket 40, cord 48, and cord lock 50 or its equivalent serve collectively to provide an engagement element disposed to attach mounting bracket 40 to the overhead environmental support.

It is presently preferred that a rigid sleeve such as metallic or plastic tube 52 be provided and located as follows. With cord 48 having been passed around upper member 54 of mounting bracket 40, cord 48 is passed through tube 52 and then through cord lock 50. Upper member 54 becomes a supporting surface on which mounting bracket rests when cord 48 is supported from above. Cord lock 50 prevents tube 52 and hence bracket 40 from slipping down along cord 48. Tube 52 both provides a resting place other than cord lock 50 and also serves as a spacer which enables cord lock 50 to be located accessibly and visibly below mounting bracket 40.

FIG. 9 shows how bracket 40 and its projection 44 interact with elongated bar 12. Interengagement is generally similar as that depicted in FIG. 1.

Mounting brackets 10 of FIG. 1 and 40 of FIG. 8 are preferably arranged such that their respective lengths are closer to vertical than to horizontal, when in the deployed condition supporting a fabric article 2. This orientation assists in resisting distortion which might result from the weight of fabric article 2.

Figure 10:
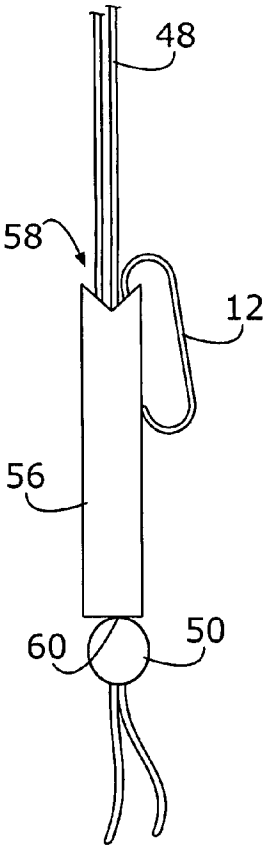
FIG. 10 is a side elevational view of an alternative embodiment, corresponding to FIG. 8.

FIG. 10 shows a variation on the embodiment of FIG. 8. In FIG. 10, tube 56 has two structural modifications compared to tube 52 of FIGS. 8 and 9. At its top, tube 56 has a V-shaped groove 58 which enables elongated bar 12 to seat therein, thereby eliminating necessity for a separate mounting bracket such as bracket 40 of FIG. 8. The second modification is rounding of the bottom end of tube 56, shown at 60, which receives cord lock 50 in close cooperation therewith. Tube 56 thus cooperates with cord 48, cord lock 50, and elongated bar 12, the latter three components having played corresponding roles in the embodiment of FIG. 8.

Figure 11:
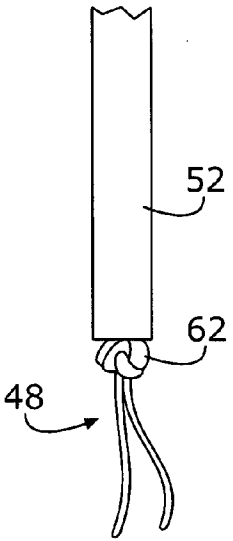
FIG. 11 is a side elevational view of a further variation on the embodiment of FIG. 8.

FIG. 11 shows a further variation on the embodiment of FIG. 8. In FIG. 11, cord lock 50 is eliminated in favor of a knot 62 formed in cord 48. This embodiment may employ either tube 52, as depicted, or tube 56 of FIG. 10.

Figure 12:
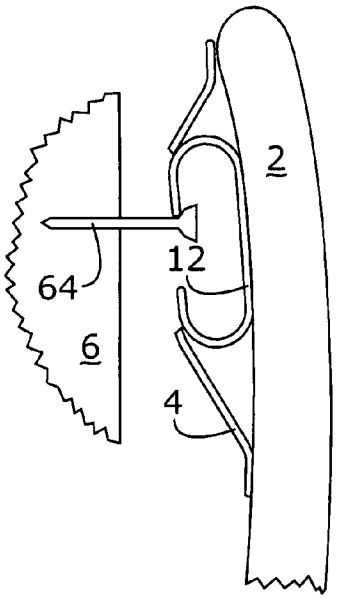
FIG. 12 is an environmental, side elevational view of an alternative embodiment of the invention.

FIG. 12 shows an alternative embodiment of the invention wherein a fastener having an enlarged head, such as screw 64 (or nail, etc.), is used in place of mounting bracket 10 of FIG. 1. Screw 64 is driven into wall 6 and engages elongated bar 12 in the same manner as projection 20 of FIG. 1. The shank of screw 64 serves as an engagement element disposed to attach screw 64 to the environmental support, which is in this embodiment wall 6. The head of screw 64 serves as a projection for engaging elongated bar 12.

Fabric article 2 and sleeve 4 are also engaged in similar manner as in FIG. 1, although sleeve 4 is not fully shown in FIG. 12. Obviously, in fabric articles having a series of loops affixed near the top edge in place of sleeve 4, screw 64 will directly contact elongated bar 12 as shown, whereas sleeve 4, where present, would actually intervene to separate screw 64 from elongated bar 12.

Figure 13:
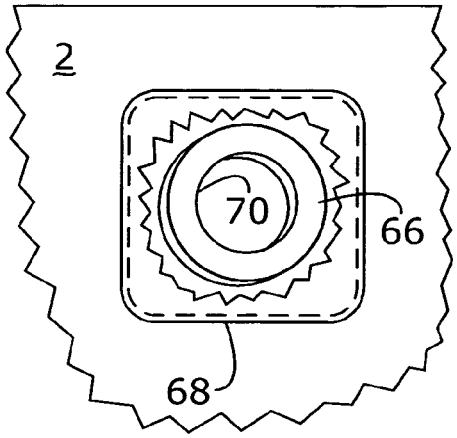
FIG. 13 is a fragmentary, environmental side elevational view of another embodiment of the invention.

FIG. 13 shows an alternative embodiment of the invention wherein elongated bar 12 is eliminated in favor of one or more hole bearing members such as washer 66. Washer 66 is permanently affixed to fabric article 2 by enclosing washer 66 within a loose fitting pocket formed by stitching a patch 68 onto the back of fabric article 2 in place of or in addition to sleeve 4. Patch 68 may be stitched to sleeve 4 or to loops if desired, in order to avoid impinging directly on fabric article 2. The projection of a suitable mounting bracket enters opening 70 of washer 66 to engage the latter.

Figure 14:
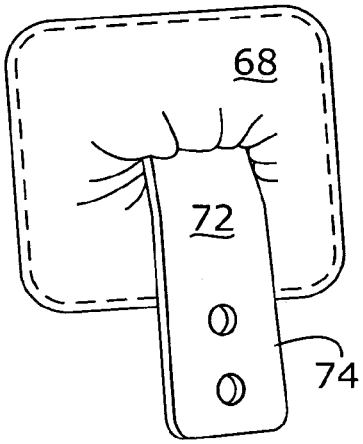
FIG. 14 is a rear perspective detail view showing a further stage of assembly of the embodiment of FIG. 13.

FIG. 14 provides a rear view showing engagement of washer 66 (not visible in FIG. 14) is engaged by the projection 72 of a mounting bracket 74. Patch 68 is inwardly displaced by projection 72, seen as puckering of patch 68 in FIG. 14. The arrangement of FIGS. 13 and 14 would also work with mounting brackets 10 (see FIG. 1) and screw 64 (see FIG. 12).

Figure 15:
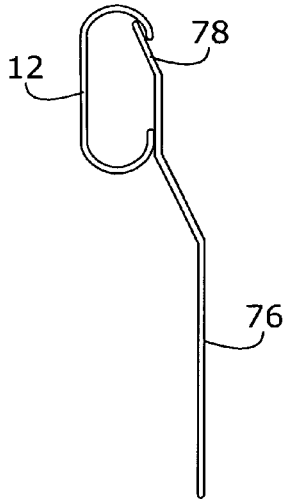
FIG. 15 is an end elevational view of another embodiment of the invention, showing a variation of the embodiment of FIG. 4.

Other modifications may be made to the components of the novel suspension system. Illustratively, and referring to FIG. 15, mounting bracket 76 is generally similar to mounting bracket 10 (see FIG. 4), having a projection 78 for engaging elongated bar 12, but lacks tabs 30, 32 of mounting bracket 10 (see FIG. 1). FIG. 15 also shows seating of elongated bar 12 at the top of projection 78, as opposed to seating in the valley formed between projection 20 and tabs 30 and 32 of mounting bracket 10, as seen in FIG. 4.

Figure 16:
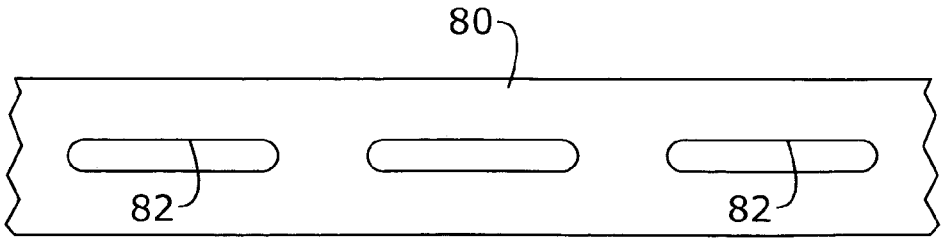
FIG. 16 is an elevational view of another embodiment of the component shown at the upper right of FIG. 2.

In a further modification shown in FIG. 16, elongated bar 80, which is in other ways a structural and functional counterpart of elongated bar 12 of FIG. 2, has a series of openings 82 rather than single continuous slot 22 seen in elongated bar 12 (shown in FIG. 2). Openings 82 may obviously depart from the elliptical configuration shown in FIG. 16. Illustratively, square, rectangular, and circular openings (not shown) may be utilized, among others.

It should be stressed that the component which attaches to fabric article 2, such as elongated bar 12 of FIG. 1, elongated bar 80 of FIG. 16, and washer 66 of FIG. 13, are interface elements which adapt fabric article 2 to present a rigid, durable receptacle for receiving a projection such as projection 20 (FIG. 1), projection 64 (FIG. 12), or projection 72 (FIG. 14), or any other projection (none shown). The projection is fixed to a supporting environmental surface or object, and the receptacle is fixed to fabric article 2. Fabric article 2 is then mounted to its supporting environmental surface or object by placing it into engagement with the appropriate projection.

Figure 17:
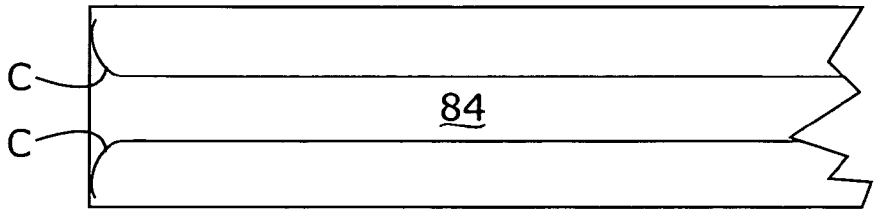
FIG. 17 is a side elevational detail view of a further embodiment of a component shown at the upper right of FIG. 2.

In a preferred embodiment shown in FIG. 17, elongated bar 84, which is in other respects structurally and functionally similar to elongated bar 12, is preferably formed such that corners C are rounded or radiused to prevent snagging of quilt fabric and other textiles.

Figure 19:
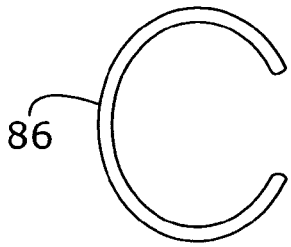
FIG. 19 is an end elevational view of another embodiment of the component shown at the upper right of FIG. 2.

Referring now to FIG. 19, elongated bar 86, which is in other respects structurally and functionally similar to elongated bar 12, is an alternative embodiment wherein the flat broad back of elongated bar 12 is eliminated.

Figure 18:
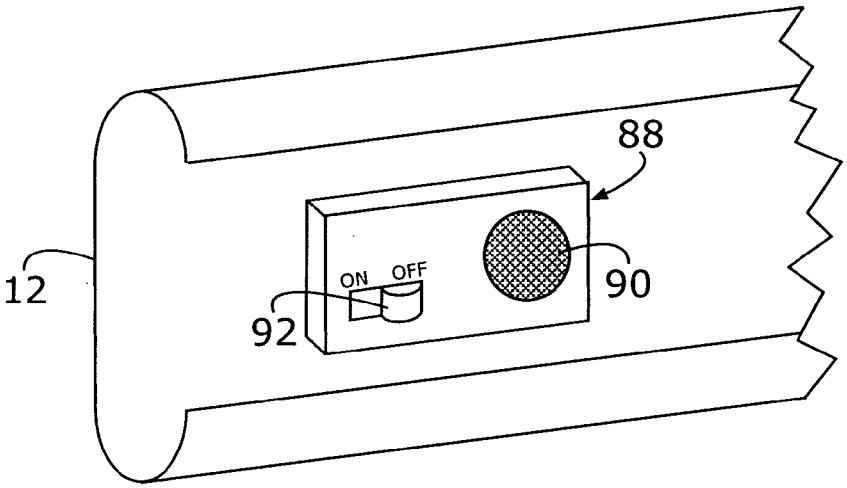
FIG. 18 is a perspective detail view of another embodiment of the invention.

FIG. 18 shows an optional feature of the invention. A motion detector 88 is affixed to elongated bar 12. Motion detector 88 is a conventional device which includes an internal battery cell (not visible in FIG. 18), an audible alarm 90, and an on-off switch 92. The audible alarm will sound if elongated bar 12 is moved beyond a predetermined degree, as would occur if the fabric article suspended thereon were being removed. It would be possible to modify the alarm to provide visible indication in addition to or instead of audible indication of motion, and to include in addition to or instead of audible and visible outputs a radio frequency or other radiant energy signal for reporting motion to a remote monitoring station (not shown).

The invention may also be thought of as a method of suspending fabric article 2 having a sleeve 4 or instead having loops (not shown) extending horizontally therealong from a vertical surface or from above. The method comprises the steps of providing elongated bar 12 having at least one slot 22 formed therein and providing at least one mounting bracket 10 or 40 having a projection (20 or 44, respectively) which is dimensioned and configured to enter and occupy slot 22 while leaving sufficient room to entrap fabric within slot 22 between elongated bar 12 and projection 20 or 44, with fabric article 2 supportingly engaged by elongated bar 12. The following steps are practiced in the method. Mounting bracket 10 or 40 is secured to a supporting environmental surface such as, for example, wall 6, a ceiling surface, or alternatively suspended from above by a rod, pole, chain, hook, clip, or cable, as described with regard to the embodiment of FIGS. 8 and 9. A step of placing elongated bar 12 inside sleeve 4 of fabric article 2 is performed. Elongated bar 12 is placed against mounting bracket 10 or 40 such that respective projection 20 or 44 enters into and occupies slot 22 while entrapping fabric of sleeve 4 between elongated bar 12 and projection 20 or 44, while avoiding penetrating through the fabric and also while obviating need for a preformed opening (not shown) which might otherwise be required in sleeve 4 to receive projection 20 or 44 of mounting bracket 10 or 40. Optionally and preferably, the method includes the further steps of providing elongated bar 12 as a telescoping bar formed in two or more sections each of which slidably engages the other, and adjusting telescoping elongated bar 12 such that it is slightly shorter than sleeve 4 of fabric article 12.

It will be appreciated that while description of the invention has made reference to sleeves formed at the top of a fabric article, the top being the uppermost portion of the article when the article is hanging and generally occupying a vertical plane, other structure can be substituted for the sleeve as shown and described. For example, the sleeve may have openings or windows at the back or front or both to enable suspension using hooks in addition to being used as described herein. These windows or openings may be small or large. It will be further appreciated that as the windows become quite large, the amount of material in the sleeve becomes commensurately small. With windows which are quite large, remaining sleeve material may take the form of loops. The sleeve may take the form of a tab which does not close on itself to form a closed loop, as long as there is sufficient material to be entrapped in a serpentine path or otherwise secured by engagement with elongated bar 12 and mounting bracket 10 or 40. Therefore, the term "sleeve" as employed herein is intended to encompass all constructions ranging from continuous, uninterrupted sleeves to one or more loops attached to the top of the fabric article.

It should be stressed at this point that the novel suspension system works both with fabric articles 2 provided with full sleeves 4, and also with fabric articles having loops (not shown). This is because whereas projections 20 or 44 of the brackets must engage elongated bar 12, projections 20, 44 can do so either by pinching or engaging sleeve 4, or alternatively, in the absence of sleeve 4, directly engaging elongated bar 12, the latter engaging loops (not shown) at locations spaced apart from brackets 10. Method steps set forth above may be modified to reflect the absence of sleeve 4 where projections 20 or 44 engage elongated bar 12.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A suspension system for vertically suspending, from an environmental support, a fabric article having an upper sleeve or loops extending generally horizontally therealong proximate an upper edge thereof, comprising:

an elongated non-circular receptacle bearing member having a generally rearward facing slot, and said elongated non-circular receptacle bearing member is sized and configured to occupy an upper sleeve or loops of a fabric article to be suspended in weight supportive relation thereof when deployed; and an upper mounting member comprising a forward facing and upwardly directed projection that engages said generally rearward facing slot of said elongated, non-circular receptacle bearing member in weight supportive relation thereof when deployed; and an engagement element disposed to attach said mounting member to an environmental support;

whereby said suspension system supports by said upper sleeve or loops a weight of said fabric article and transfers said weight to said environmental support.

2. The suspension system according to claim 1, wherein said elongated non-circular receptacle bearing member comprises an elongated bar.

3. The suspension system according to claim 2, wherein said elongated bar is formed in at least two generally similar sections each of said sections slidably engages another one of said at least two generally similar sections allowing sliding adjustment thereof to selectively determine a combined length of said at least two generally similar sections.

4. The suspension system according to claim 2, wherein said elongated bar includes a substantially vertical member opposite said slot, said substantially vertical member being substantially flat and vertically oriented when said elongated bar is in a deployed position, thereby opposing bulging of the fabric article where the fabric article contacts said elongated bar.

5. The suspension system according to claim 2, wherein said upper mounting member is an upper mounting bracket and said upper mounting bracket and said elongated bar each have corresponding abutment portions which oppose pivotal disengagement of said elongated bar from said projection of said upper mounting bracket by interference, wherein said corresponding abutment portions are located substantially below a point of weight supporting contact of said upper mounting bracket and said elongated bar when said suspension system is in the deployed condition.

6. The suspension system according to claim 1, wherein said elongated receptacle bearing member and said mounting member are substantially concealed by said fabric article when said fabric article is suspended therefrom.

7. The suspension system according to claim 1, wherein said upper mounting member is an upper mounting bracket.

8. The suspension system according to claim 1, wherein said forward facing and upwardly directed projection is dimensioned and configured to enter and occupy said generally rearward facing slot thereby moving a portion of the said sleeve or loops of said fabric article contacting said projection into said generally rearward facing slot.

9. A support system for suspending a fabric article from an environmental support, the fabric article having a weight-bearing component comprising at least one sleeve or a series of loops proximate an upper edge thereof that carry a weight of the suspended fabric article, comprising:

a non-circular elongated bar having a generally rearward facing opening, which when deployed, occupies and engages a weight-bearing component of a suspended fabric article and in so doing supports the weight of said suspended fabric article; and an upper mounting member comprising a forward facing and upwardly directed projection, which when deployed, said forward facing and upwardly directed projection engages said generally rearward facing opening of said non-circular elongated bar in supportive relation thereto, thus transferring the weight of said fabric article to said upper mounting member; and an engagement element disposed to transfer the weight of said fabric article from said upper mounting member to an environmental support.

10. The suspension system according to claim 9, wherein said elongated non-circular receptacle bearing member comprises an elongated bar.

11. The suspension system according to claim 10, wherein said elongated bar is formed in at least two generally similar sections each of said sections slidably engages another one of said at least two generally similar sections, allowing sliding adjustment thereof to selectively determine a combined length of said at least two generally similar sections.

12. The suspension system according to claim 10, wherein said elongated bar includes a substantially vertical member opposite said opening, said substantially vertical member being substantially flat and vertically oriented when said elongated bar is in a deployed position, thereby opposing bulging of the fabric article where the fabric article contacts said elongated bar.

13. The suspension system according to claim 10, wherein said mounting member and said elongated bar each have corresponding abutment portions which oppose pivotal disengagement of said elongated bar from said projection of said mounting member by interference, wherein said corresponding abutment portions are located substantially below a point of weight supporting contact of said mounting member and said elongated bar when said suspension system is in the deployed condition.

14. The suspension system according to claim 9, wherein said non-circular elongated bar can be circular and said upper mounting member is an upper mounting bracket and said upper mounting bracket and said elongated bar each have corresponding abutment portions which oppose pivotal disengagement of said elongated bar from said projection of said upper mounting bracket by interference, wherein said corresponding abutment portions are located substantially below a point of weight supporting contact of said upper mounting bracket and said elongated bar when said suspension system is in the deployed condition.

15. A method of suspending a fabric article from an environmental support, the fabric article having a weight-bearing component comprising at least one sleeve or a series of loops extending generally therealong proximate an upper edge thereof, the method comprising the steps of:

providing a non-circular elongated bar having a generally rearward facing slot providing an upper mounting member having a forward facing and upwardly directed projection providing an engagement element disposed to attach said upper mounting member to an environmental support placing said non-circular elongated bar into weight-supporting engagement with said weight bearing component of said fabric article; and attaching said upper mounting member using said engagement element to said environmental support putting said forward facing and upwardly directed projection of said upper mounting member into weight-supporting engagement with said generally rearward-facing slot of said non-circular elongated bar whereby a weight of said fabric article is carried by said environmental support.

* * * * *